US007484459B2

(12) United States Patent
Fichot et al.

(10) Patent No.: US 7,484,459 B2
(45) Date of Patent: Feb. 3, 2009

(54) FIREARM AMMUNITION PROJECTILE

(75) Inventors: Christophe Fichot, Le Chesnay (FR); Pierre Deloume, Le Chesnay (FR); Jean-Jacques Dorrzapf, Le Chesnay (FR)

(73) Assignee: Etat Francais Represente par le Ministere de l 'Interieur de la Securite Interieure et des Libertes Locales Represente par la Direction Generale de la Police Nationale, Paris (FR)

( * ) Notice: Subject to any disclaimer, the term of this patent is extended or adjusted under 35 U.S.C. 154(b) by 9 days.

(21) Appl. No.: 10/531,490

(22) PCT Filed: Oct. 15, 2003

(86) PCT No.: PCT/FR03/03036

§ 371 (c)(1),
(2), (4) Date: Apr. 15, 2005

(87) PCT Pub. No.: WO2004/036140

PCT Pub. Date: Apr. 29, 2004

(65) Prior Publication Data

US 2006/0096491 A1 May 11, 2006

(30) Foreign Application Priority Data

Oct. 17, 2002 (FR) ..... 02 12922

(51) Int. Cl.
*F42B 10/22* (2006.01)
*F42B 10/24* (2006.01)

(52) U.S. Cl. ..... 102/501

(58) Field of Classification Search ..... 102/501, 102/503, 518, 519
See application file for complete search history.

(56) References Cited

U.S. PATENT DOCUMENTS

| | | | | | |
|---|---|---|---|---|---|
| 3,200,751 | A | * | 8/1965 | Vitt | 102/519 |
| 3,572,250 | A | * | 3/1971 | Kriesel et al. | 102/398 |
| 3,580,179 | A | * | 5/1971 | Gawlick et al. | 102/503 |
| 3,949,677 | A | * | 4/1976 | Voss | 102/501 |
| 4,450,769 | A | * | 5/1984 | Moser | 102/444 |
| 4,616,568 | A | * | 10/1986 | Serge | 102/501 |

(Continued)

FOREIGN PATENT DOCUMENTS

| | | |
|---|---|---|
| DE | 1678197 | 2/1972 |

(Continued)

*Primary Examiner*—David J Parsley
(74) *Attorney, Agent, or Firm*—Davis & Bujold P.L.L.C.

(57) ABSTRACT

An ammunition projectile for a firearm comprising a projectile having a nose and a cap which is designed to slow down sufficiently, when traveling through air so as to be stopped by a bulletproof vest while the projectile still has a precise and reliable trajectory. The projectile (10) has a generally truncated nose (11) and a cylindrical cap (12). The nose (11) is provided with a central, essentially circular flat section (13) which can be made larger or smaller and which has a diameter of between 10 and 50% of the diameter of the projectile at the base of the nose (11) or the cap (12). The lateral face of the truncated nose (11) is provided with five indentations (14) which are disposed symmetrically in relation to axial planes and which are obtained by one of stamping, milling, or some other suitable machining method.

20 Claims, 4 Drawing Sheets

U.S. PATENT DOCUMENTS

| | | | | | |
|---|---|---|---|---|---|
| 4,867,065 | A | * | 9/1989 | Kaltmann et al. | 102/444 |
| 5,027,711 | A | * | 7/1991 | Schleicher et al. | 102/521 |
| 5,133,261 | A | * | 7/1992 | Kelsey, Jr. | 102/439 |
| 5,259,320 | A | * | 11/1993 | Brooks | 102/509 |
| 5,385,100 | A | * | 1/1995 | Corzine et al. | 102/507 |
| 5,932,836 | A | | 8/1999 | White | |
| 6,182,574 | B1 | * | 2/2001 | Giannoni | 102/516 |
| 6,223,657 | B1 | * | 5/2001 | Proffitt | 102/444 |
| 6,244,186 | B1 | * | 6/2001 | Pichard | 102/508 |
| 6,363,856 | B1 | | 4/2002 | Stoker, Jr. et al. | |

FOREIGN PATENT DOCUMENTS

| | | |
|---|---|---|
| DE | 4227068 | 2/1994 |
| EP | 0015574 | 9/1980 |
| FR | 852603 | 2/1940 |
| FR | 2286364 | 4/1976 |
| FR | 2381275 | 9/1978 |
| FR | 2517764 | 6/1983 |
| FR | 2820495 | 8/2002 |
| RU | 2002201 | 10/1993 |
| RU | 2070716 | 12/1996 |

* cited by examiner

FIG. 4
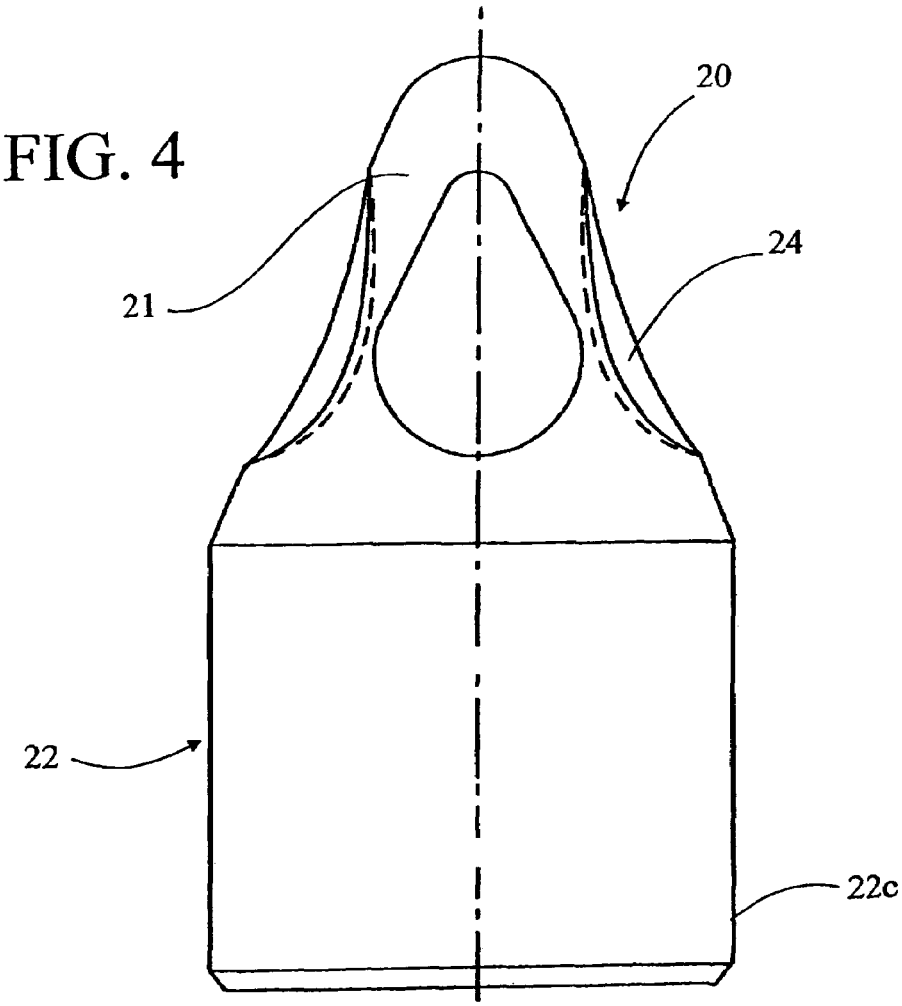
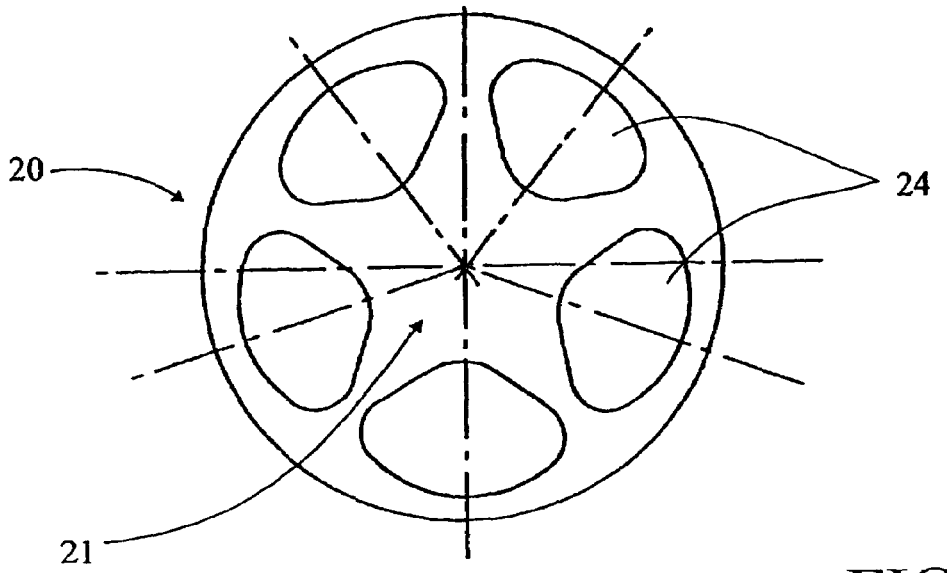
FIG. 6

FIREARM AMMUNITION PROJECTILE

This application is a national stage completion of PCT/FR2003/003036 filed Oct. 15, 2003 which claims priority from French Application Serial No. 02/12922 filed Oct. 17, 2002.

FIELD OF THE INVENTION

The present invention concerns an ammunition projectile for a firearm, particularly a handgun, said projectile comprising a nose and a cap.

BACKGROUND OF THE INVENTION

Projectiles known in the prior art have various disadvantages. For the most part, they are lead-based, causing them to generate considerable pollution in firing ranges during training and competitions. Additionally, when used outdoors, their kinetic energy dissipates very slowly. For this reason, when used in public, they are capable of passing through two people, one after the other, making them especially dangerous. Because of this they are incompatible with use by police forces.

Publication FR-A-2 517 764 describes a training shell used for shooting training and regulating artillery pieces. This training shell is specifically designed for short distance simulations of actual longer range firings in order to identify the reasons for lack of precision and to better regulate the weapon. To recreate realistic control conditions, the precision of the short range firing of the shell is altered. In order for this to occur, the shell comprises an interior cavity, with one extremity having a flat area and a hollow portion designed to modify the shell's center of gravity. The hollow portion is asymmetrical so that once the shell is caused to rotate by the grooves in the gun barrel, its trajectory deviates slightly. This shell does not ensure a precise trajectory and cannot be adapted to handguns. Therefore it does not offer a satisfactory solution.

Publication EP-A-0 015 574 describes a hunting projectile comprising helicoidal grooves that resist rotation during the projectile's trajectory. Thus, once the projectile has traveled for a certain distance, for example 300 meters for hunting weapon projectiles, the helicoidal grooves slow rotation on the trajectory, making it unstable and causing it to tilt down toward the ground. Therefore, the course of the projectile is stopped prematurely. Its maximum range is shortened. The helicoidal grooves that provide a cleaner impact orifice have no immediate slowing effect. Therefore, this solution is not satisfactory.

Publication U.S. Pat. No. 6,363,856 describes ammunition for a handgun with an extremity that comprises a flat area. Because the projectile has a smaller mass than projectiles in current use, when it is discharged the speed of the projectile decreases rapidly, reducing the range of danger. This ammunition further comprises a jacket which separates from the projectile on impact, giving it additional power to simultaneously penetrate the target and fragment so the projectile does not reach unintended targets. This projectile is lightened through the use of very light resins that considerably diminish its aerodynamics and the precision of its trajectory. Therefore, this is not a satisfactory solution.

Publication FR-A-2 820 495 describes an ammunition projectile of reduced range comprising a hollow body extending into a rounded nose cone having a plurality of hollow impressions defined by two planes forming a dihedron with its central ridge parallel to the axis of the nose cone. These hollow impressions are designed to slow the rotation of the projectile imposed by the ridges in the gun barrel. Thus, as with publication EP-A-0 015 574, the projectiles are slowed by destabilizing them. Because these projectiles leave their trajectory in mid course, their range is reduced. Slowing does not occur immediately. Thus, this solution is unsatisfactory.

SUMMARY OF THE INVENTION

The aim of the present invention is to overcome these disadvantages by proposing a projectile for a firearm with a precise, reliable trajectory, with limited penetration in a soft medium, and which, depending upon the manner of manufacture, is capable of either passing through or being stopped by a bullet-proof vest.

This aim is achieved by a projectile such as the one described in the preamble, characterized in that the nose is essentially conical in shape and comprises at least two hollow areas that are essentially symmetrical, said hollow areas being curved from one edge to the other.

The hollow areas preferably have a rounded base, allowing the ammunition equipped with this projectile to be used without becoming lodged in an automatic weapon.

The hollow areas may be formed of two curvilinear planes, the intersection of which is defined by a radial ridge.

According to a first embodiment, the nose comprises a central flat area having a diameter advantageously ranging from 10 to 50% of the diameter of the projectile at the base of the nose, and preferably ranging from one-fourth to one-third of the diameter of the projectile.

Furthermore, according to the first embodiment, the nose and the cap comprise a groove.

In a particularly advantageous manner, the groove is designed to receive a blocking means.

According to a preferred embodiment, the projectile is made of soft metal and specifically, may be made of copper or one of its alloys.

The blocking means is made of hard metal to absorb the forces the projectile is subjected to, for example, steel.

The groove preferably comprises a central zone that is at least partially threaded and said blocking means is a bolt partially engaged within said central zone.

Preferably the projectile is formed of a piece of brass.

BRIEF DESCRIPTION OF THE DRAWINGS

The features of the present invention will be more apparent from the following description of two principal embodiments of the invention, with reference to the attached drawings, provided by way of non-limiting examples, wherein:

FIG. 4 is an elevation of a second embodiment of a projectile according to the invention;

FIG. 6 is view of the top of the projectile of FIG. 4.

DETAILED DESCRIPTION OF THE INVENTION

Figure 1:
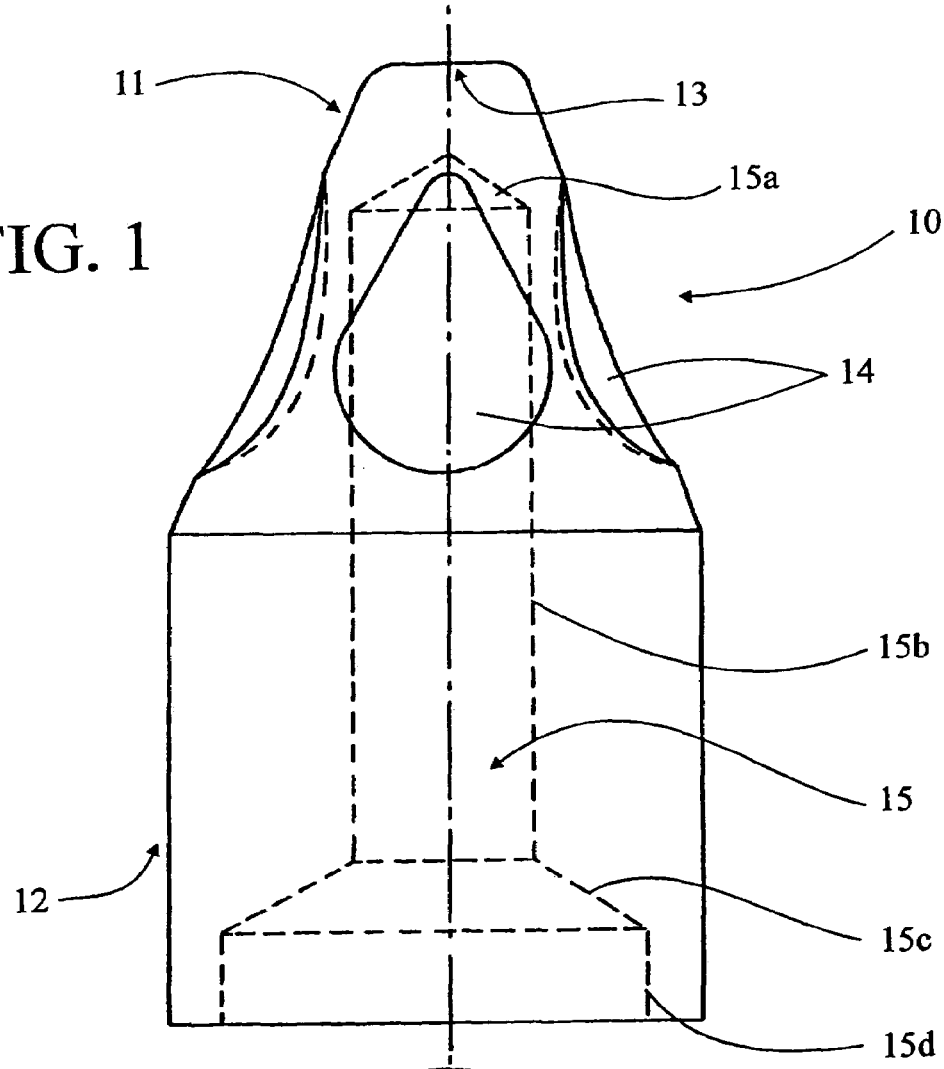
FIG. 1 represents an elevational view of a first embodiment of a projectile according to the invention.
Figure 3:
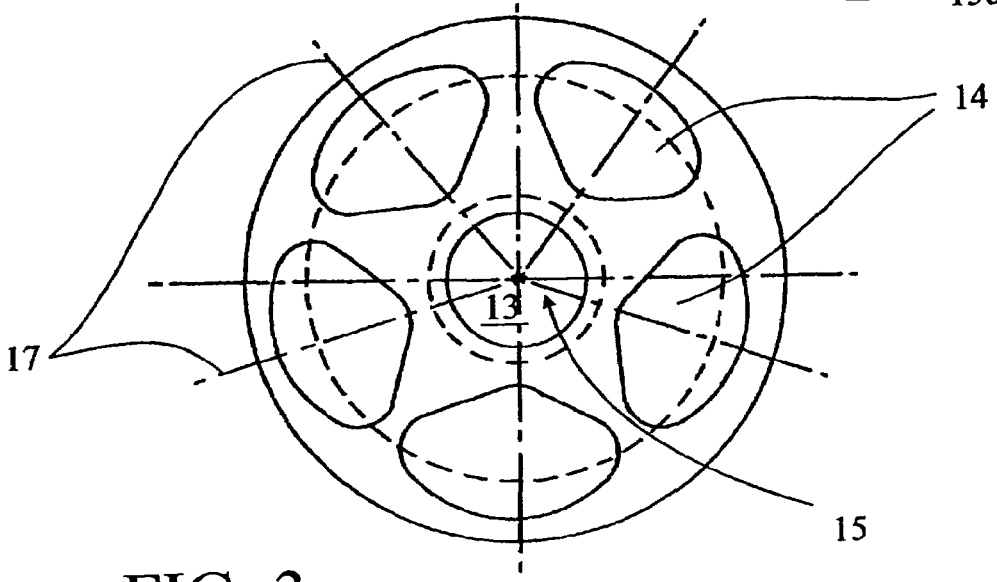
FIG. 3 is a view of the top of the projectile of FIG. 1.
Figure 2:
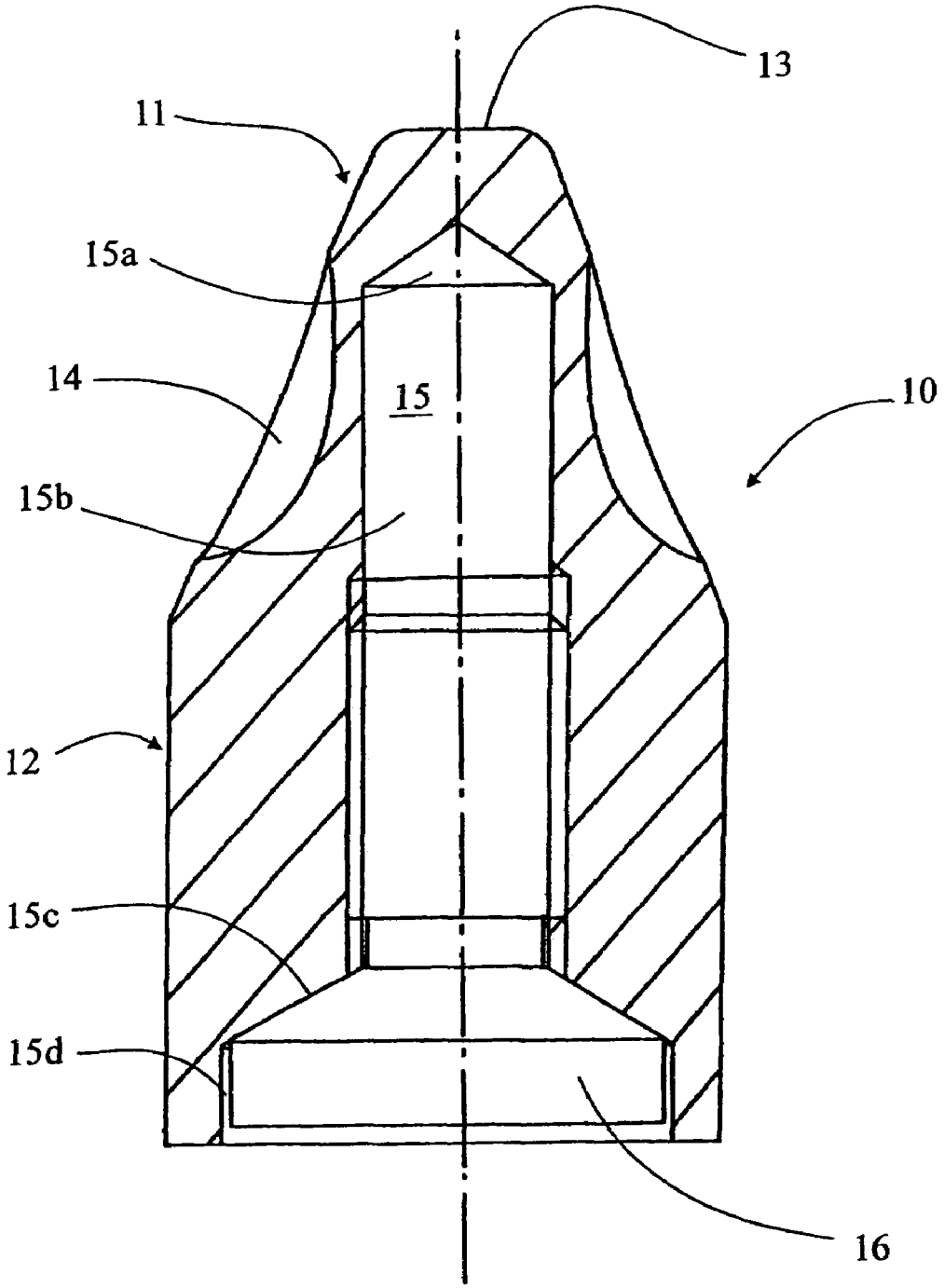
FIG. 2 represents the projectile of FIG. 1 in axial cross-section.

The projectile according to the invention illustrated by FIGS. 1 through 3 is designed principally for use by public security services. One of its essential features is that it can be stopped by a bulletproof vest, specifically a bulletproof vest consisting of 24 layers of sheets of synthetic material such as, for example, the commercial brand KEVLAR™ or any equivalent material with similar characteristics.

As shown in FIGS. 1 through 3, projectile 10 comprises an approximately conical nose 11 and a cylindrical cap 12. Conical nose 11 has an angle at the tip ranging from 30 to 45° and preferably equal to approximately 38°. It is provided with a central flat portion 13 that may be larger or smaller and which is essentially circular in shape, with a diameter ranging from 10 to 50% of the diameter of the projectile at the base of nose 11 or cap 12. Preferably, the diameter of flat area 13 essentially ranges from one-fourth to one-third of the diameter of projectile 10. On its lateral surface, nose 11 has at least two hollow areas 14 that are essentially symmetrically disposed relative to the axial planes and are formed either by stamping, milling, or some other appropriate machining method. The exemplary embodiment described and shown (see FIG. 3) shows that generally conical nose 11 has five hollow portions 14 regularly spaced along axes 17 that each form a 72° angle with the adjacent axis 17. The number of hollow portions 14 and the angular position may vary according to the embodiment and depends in particular upon the caliber of projectile 10. Each hollow area 14 has a rounded base allowing it to feed correctly so the cartridge containing projectile 10 does not become lodged in an automatic weapon. In addition, hollow areas 14 are curved from one edge to the other. The absence of any axial ridges prevents rotation of projectile 10 from being disturbed as it exits the barrel of the weapon.

In addition, projectile 10 is hollow and it comprises a cavity 15 extending axially through cylindrical cap 12 and extending into nose 11. This cavity 15 comprises a frontal area 15*a* that forms a nose extending into central cylindrical zone 15*b* that opens into an intermediate conical zone 15*c* extending into rear cylindrical zone 15*d* which is larger in section than central zone 15*b*.

Projectile 10 is preferably made of a relatively soft metal such as copper or one of its alloys. By way of non-limiting example, the projectile 10 which is described and which was used for the experiments has a diameter of 8.95 mm, a 9 mm parabellum caliber and weighs 5.6 grams. The initial speed in a GLOCK 19 with a 10 centimeter barrel is 400 m/s, with a kinetic energy of about 450 joules.

The specific truncated profile of nose 11 that is the least aerodynamic, as well as the presence of central flat portion 13 and hollow areas 14, have the effect of considerably slowing the projectile on its trajectory through the air and diminishing its penetration into a soft medium without altering the precision of the trajectory. The average penetration of projectile 10 in the reference medium, i.e., 10% gelatin, is 45 centimeters. This corresponds to a 40% decrease in relation to the result obtained with an ordinary weapon loaded with a plated bullet.

Contrary to known projectiles in which nose deformation acts to quickly decrease speed and energy in the target, the projectile 10 of the invention is slowed because of its poor index of penetration into the air, but it still maintains a well controlled trajectory. The result of this slowing is diminished penetration into a soft medium, said penetration decreasing as the range of discharge increases. The maximum range is of the order of 1200 meters, while that of known projectiles is of the order of 1800 meters.

In order for projectile 10 to resist the high pressure generated by powder combustion, a blocking means 16, for example a steel bolt, specifically a PARKER™ type bolt with a conical head, may engage inside rear cylindrical zone 15*d* and central zone 15*b* of cavity 15. This bolt can be replaced with any other blocking means such as a hard metal block located in the rear zone 15*d* of cavity 15. If blocking means 16 is a bolt, the central zone is at least partially threaded so this bolt can be screwed onto it. Intermediate zone 15*c* and rear zone 15*d* are disposed to receive the head of this screw.

Experiments show that projectile 10 such as the one described does not cause any more damage to the rubber bullet traps used in firing ranges than the plated bullets that are generally used. The diameter of the passageway opening is about two millimeters. The rubber curtains currently used as protection in firing ranges can still be used with projectile 10, so the same ammunition can be used both outdoors by security forces and in firing ranges for training. The ammunition is non-polluting since it contains no lead.

The fact that projectile 10 is hollow ensures that it cannot penetrate a bullet proof vest made of 24 layers of KEVLAR™ or the equivalent. Cavity 15 is approximately 3 millimeters in diameter in central zone 15*b* and extends into nose 11, allowing the nose to deform at the moment of impact. Nose 11 of projectile 10 also deforms upon impact with a vehicle windshield. However, projectile 10 passes through this screen with no noticeable loss of mass and blocking means 16 remains in place.

Figure 5:
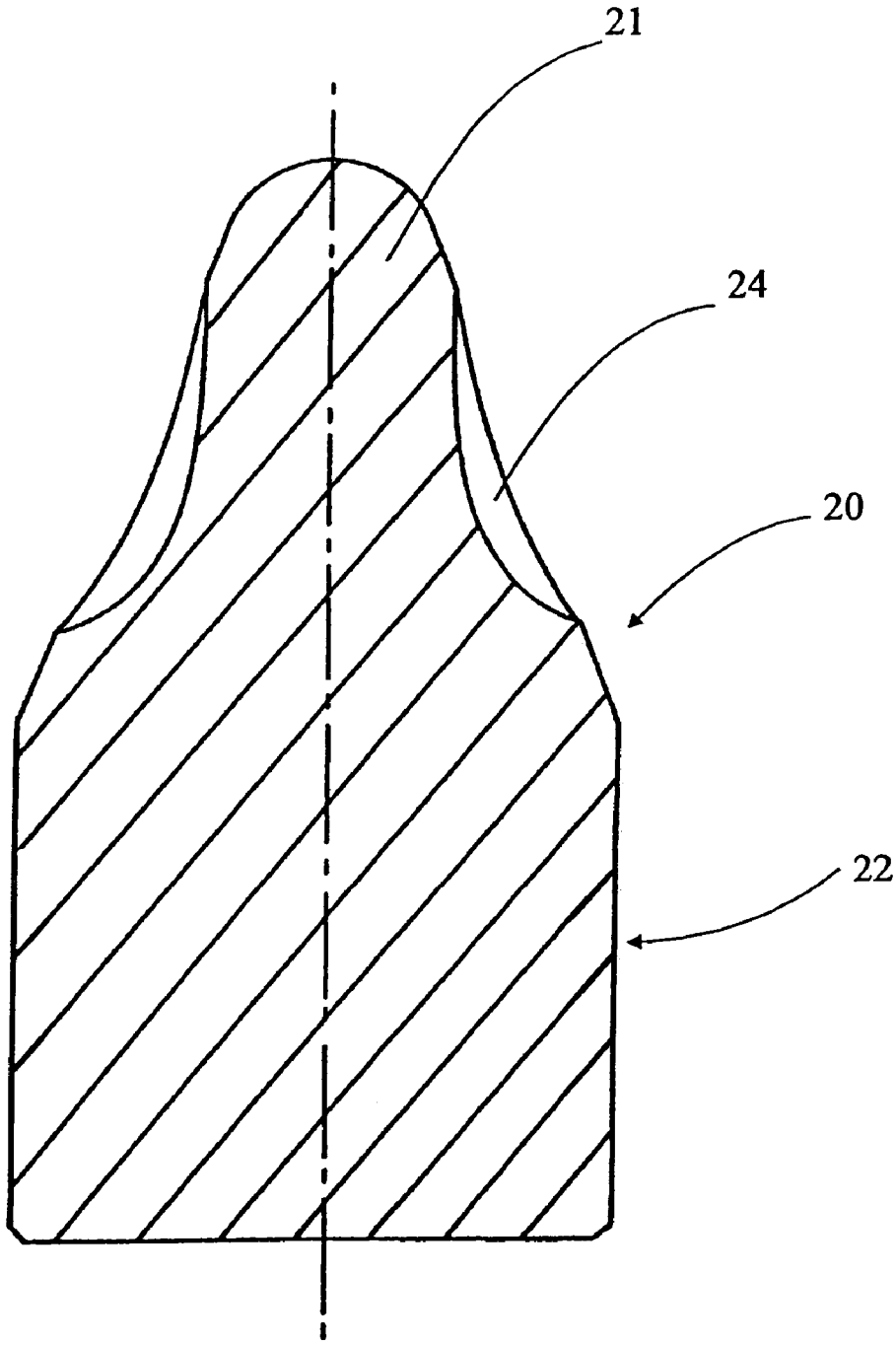
FIG. 5 represents the projectile of FIG. 4 in axial cross-section.

As shown in FIGS. 4 through 6, projectile 20 comprises an approximately conical nose 21 and a generally cylindrical cap 22. Unlike nose 11 of projectile 10, nose 21 is not equipped with flat central portion 13. On its lateral surface, generally conical nose 21 has at least two hollow areas 24, symmetrically disposed relative to the axial planes, which are formed by stamping, milling, or some other appropriate machining technique. The exemplary embodiment described and shown (see FIG. 6) demonstrates that generally conical nose 21 has five hollow areas 24, regularly spaced along axes 25 each forming 72° angles with the nearby axis. The number of hollow areas 24 and their angular position may vary depending upon the embodiment and depends in particular upon the caliber of projectile 20. Each hollow area 24 comprises a rounded base to allow it to feed correctly and to prevent the cartridge containing projectile 20 from becoming lodged in an automatic weapon. Moreover, hollow areas 24 are curved from one edge to the other. The absence of any axial ridge eliminates any effect on the rotation of projectile 20 as it exits the barrel of the weapon.

Projectile 20 also differs from projectile 10 in that it has no central cavity 15. It is massive and preferably made of brass or an alloy with similar physical properties, but not from an alloy containing lead. It may be manufactured by either hot or cold stamping and hollows 24 may be made using any appropriate machining method. Experiments have been performed using a projectile 20 such as the one described that is 8.97 mm in diameter, 9 parabellum caliber and 5.6 grams in weight and with an initial speed in a GLOCK 19 having a 10 centimeter barrel of 440 m/s and energy of approximately 450 joules.

The behavior of projectile 20 along the trajectory is essentially the same as that of projectile 10 except it is slowed to a lesser extent due to the absence of a flat central portion on nose 21. In addition, it has greater capacity for perforation, since experiments have shown that it penetrates a minimum of 48 layers of KEVLAR™ or the equivalent.

The two projectiles 10 and 20 perform differently insofar as their ability to penetrate bulletproof vests is concerned. Projectile 10 is designed to be stopped by a bulletproof vest and projectile 20 is designed to penetrate it.

In a variation, not shown, there is an even number of hollow areas disposed symmetrically in relation to the axis of the projectile.

In yet another variation, not shown, the hollows are formed by two curvilinear planes which together define a radial ridge. Since this radial ridge is in the direction of projectile rotation, it does not affect either the speed of projectile rotation or the precision of its trajectory.

The present invention is not limited to the exemplary embodiments described, but extends to any modification and variation obvious to a person skilled in the art while remaining within the scope of protection defined by the attached claims.

The invention claimed is:

1. An ammunition projectile (10, 20), for a firearm, having diminished penetration into a soft medium, said projectile (10, 20) comprising a nose (11, 21) and a cap (12, 22), said nose (11, 21) forming a leading end of the projectile and being essentially conical in shape and comprising at least two indentations (14, 24), each respective indentation being disposed in an external surface of the nose and essentially symmetrically in relation to a respective longitudinal axial plane coincident with a central longitudinal axis of said projectile and bisecting the respective indentation, each indentation having a curved profile from a first edge to a second edge symmetrical with respect to one of the respective central longitudinal axis of the projectiie and the respective longitudinal axial plane, a trailing portion and a leading portion of each of the at least two indentations (14, 24) is curved and a portion of each opposed sidewall of each of the at least two indentations is straight and connects the leading portion and the trailing portion and the portion of each opposed sidewall tapers away from one another upon extending from the leading portion to the trailing portion of the indentation so that said projectile, during trajectory of the projectile through air, is sufficiently slowed so as to diminish penetration of said projectile into a soft medium without significantly altering a trajectory precision of said projectile.

2. The projectile. (10, 20) according to claim 1, wherein a perimeter of each of the at least two indentations (14, 24) comprises a curved leading portion, a curved trailing portion, a first straight edge sidewall connecting a first end of the curved leading portion with a first end of curved trailing portion and a second straight edge sidewall connecting a second end of the curved leading portion with a second end of curved trailing portion.

3. The projectile (10, 20) according to claim 2, wherein the indentations are formed of two curvilinear planes whose intersection is defined by a radial ridge, and a radius of curvature of the trailing portion is greater than a radius of curvature of the leading portion of each of the at least two indentations (14, 24).

4. The projectile (10) according to claim 1, wherein the nose (11) comprises a flat central portion (13).

5. The projectile (10) according to claim 4, wherein a diameter of said fiat central portion (13) generally ranges from 10 to 50% of a diameter of the projectile (10) at a base of the nose (11).

6. The projectile (10) according to claim 1, wherein the nose and said cap further comprise a cavity (15).

7. The projectile (10) according to claim 6, wherein the cavity (15) is designed to receive a blocking means (16).

8. The projectile (10, 20) according to claim 1, wherein the projectile is entirely made of soft metal.

9. The projectile (10, 20) according to claim 8, wherein the projectile is made of copper.

10. The projectile (10) according to claim 7, wherein the blocking means (16) is made of hard metal.

11. The projectile (10) according to claim 10, wherein the blocking means (16) is made of steel.

12. The projectile (10) according to claim 7, wherein the cavity (15) comprises a central zone (15*b*) that is at least partially threaded and said blocking means (16) is a bolt partially engaged in said central zone (15*b*).

13. The projectile (10, 20) according to claim 1, wherein the projectile is formed of brass.

14. An ammunition projectile (10, 20), for a firearm, having diminished penetration into a soft medium, the projectile (10, 20) comprising a nose (11, 21) and a cap (12, 22), the nose (11, 21) being a leading edge of the projectile and being essentially conical in shape and comprising at least two indentations (14, 24), and each indentation being disposed in an external surface of the nose and symmetrically in relation to a longitudinal plane bisecting the respective indentation and coincident with a central longitudinal axis of the projectile, each indentation having a curved profile from a first edge to a second edge symmetrical to the longitudinal plane, a perimeter of each of the at least two indentations (14, 24) comprises a curved leading portion, a curved trailing portion, a first straight edge sidewall connecting a first end of the curved leading portion with a first end of the curved trailing portion and a second straight edge sidewall connecting a second end of the curved leading portion with a second end of the curved trailing portion such that the first and the second straight edge sidewalls taper away from one another upon extending from the leading portion to the trailing portion so that the projectile, during trajectory of the projectile through air, is sufficientiy slowed so as to diminish penetration of the projectile into a soft medium without significantly altering a trajectory precision of the projectile.

15. The projectile (10) according to claim 14, wherein a leading central portion (13) of the nose (11, 21) is flat and a radius of curvature of the trailing portion is greater than a radius of curvature of the leading portion of each of the at least two indentations (14, 24).

16. The projectile (10) according to claim 15, wherein a diameter of the leading central portion (13) of the nose (11, 21) generally ranges from 10 to 50% of a diameter of the projectile (10) at a baBe of the nose (11).

17. The projectile (10) according to claim 14, wherein the nose and said cap further comprise a cavity (15).

18. The projectile (10) according to claim 17, wherein the cavity (15) receives a blocking member (16).

19. The projectile (10, 20) according to claim 14, wherein the projectile is manufactured from copper.

20. An ammunition projectile (10, 20), for a firearm, having diminished penetration into a soft medium, the projectile (10, 20) comprising a nose (11, 21) and a cap (12, 22), the nose (11, 21) having a flat leading central portion (13) and being substantially conical in shape and comprising a plurality of indentations (14, 24), and each indentation being disposed in an external surface of the nose and symmetrically in relation to a longitudinal plane, bisecting the respective indentation to substantially mirror image sections and coincident with a central longitudinal axis of the projectile, each respective indentation having a curved profile with a leading edge of each indentation being spaced from the flat leading central portion (13), a perimeter of each of the at least two indentations (14, 24) comprises a curved leading portion, a curved trailing portion, a first straight edge sidewall connecting a first end of the curved leading portion with a first end of the curved trailing portion and a second straight edge sidewall connecting a second end of the curved leading portion with a second end of the curved trailing portion and a radius of curvature of the trailing portion is greater than a radius of curvature of the leading portion of each of the at least two indentations (14, 24) such that the first and the second straight edge sidewalls taper away from one another upon extending from the leading portion to the trailing portion so that the projectile, during trajectory of the projectile through air, is sufficiently slowed so as to diminish penetration of the projectile into a soft medium without significantly altering a trajectory precision of the projectile.

* * * * *